US006190128B1

(12) United States Patent
Fukuno et al.

(10) Patent No.: US 6,190,128 B1
(45) Date of Patent: Feb. 20, 2001

(54) COOLED MOVING BLADE FOR GAS TURBINE

(75) Inventors: Hiroki Fukuno; Yasuoki Tomita; Shigeyuki Maeda; Yukihiro Hashimoto; Kiyoshi Suenaga, all of Hyogo-ken (JP)

(73) Assignee: Mitsubishi Heavy Industries, Ltd., Tokyo (JP)

( * ) Notice: Under 35 U.S.C. 154(b), the term of this patent shall be extended for 0 days.

(21) Appl. No.: 09/230,942

(22) PCT Filed: Jun. 12, 1998

(86) PCT No.: PCT/JP98/02596

§ 371 Date: Feb. 4, 1999

§ 102(e) Date: Feb. 4, 1999

(87) PCT Pub. No.: WO98/57042

PCT Pub. Date: Dec. 17, 1998

(30) Foreign Application Priority Data

Jun. 12, 1997 (JP) ..... 9-155123

(51) Int. Cl.[7] ..... F01D 5/08

(52) U.S. Cl. ..... 416/96 R; 416/97 R; 416/223 A; 416/239; 416/248

(58) Field of Search ..... 416/97 R, 96 R, 416/97 A, 96 A, 241 B, 243, 248, 193 A, 239, 223 A; 415/115

(56) References Cited

U.S. PATENT DOCUMENTS 3,890,062 * 6/1975 Hendrix et al. ..... 416/234
4,244,676 * 1/1981 Grondahl et al. ..... 416/92
4,563,128 * 1/1986 Rossmann ..... 416/92
5,340,278 * 8/1994 Magowan ..... 416/96 R

FOREIGN PATENT DOCUMENTS 51-27701 2/1976 (JP) .
60-14203 1/1985 (JP) .
6-60701 8/1994 (JP) .
8-177401 7/1996 (JP) .

* cited by examiner

*Primary Examiner*—Edward K. Look
*Assistant Examiner*—Ninh Nguyen
(74) *Attorney, Agent, or Firm*—Sughrue, Mion, Zinn, Macpeak & Seas, PLLC

(57) ABSTRACT

A cooled moving blade for a gas turbine which has a blade profile capable of more effectively reducing thermal stress in a blade base portion and, thus, preventing cracks from occurring. A moving blade (1) is fixedly secured to a platform (2). On the other hand, a cooling air passage (3) is formed in a serpentine pattern inside of the blade for cooling with cooling air. The moving blade (1) has a base portion of a profile formed by an elliptically curved surface (11) and a rectilinear surface portion (12), wherein the rectilinear surface portion (12) is provided at a hub portion of the blade where thermal stress is large. The cross-sectional area of the blade is increased by providing the rectilinear surface portion (12) The heat capacity is increased, compared with the conventional blade, due to the increased cross-sectional area of the blade. This, in turn, results in a decrease of the temperature difference due to the thermal stress. Thus, the thermal stress can be suppressed more effectively than with the conventional blade.

6 Claims, 4 Drawing Sheets

COOLED MOVING BLADE FOR GAS TURBINE

BACKGROUND OF THE INVENTION

1. Technical Field of the Invention

The present invention relates to a cooled moving blade for a gas turbine, and more particularly to a cooled moving blade formed in such a geometrical configuration that thermal stress induced between a base portion of the blade and a platform can be reduced.

2. Description of the Related Art

FIG. 5 is a perspective view showing a conventional cooled moving blade for a gas turbine. Referring to the figure, a moving blade 1 is mounted on a platform 2 disposed around a rotor (not shown), wherein a cooling air passage 3 is formed inside of the moving blade 1 between a leading edge thereof and a trailing edge in a serpentine pattern that sequentially extends upward and downward in a repetitious and continuous manner. The cooling air is introduced into the cooling air passage 3 from a port located on the inner side of the leading edge of the moving blade 1 by way of a blade root (not shown) portion and is discharged from holes formed in the trailing edge portion of the blade after having blown through the cooling air passage 3. In the figure, reference numeral 4 denotes a curved surface forming a blade surface of the moving blade 1 and numeral 5 designates a fillet ellipse portion R formed in the blade base portion, which will be described below.

FIG. 6 is a schematic diagram showing the portion B shown in FIG. 5 in detail, and more specifically it shows a blade profile of the base portion of the moving blade 1. The base portion of the moving blade 1 is shaped in a curved surface conforming to an ellipse 6, wherein the fillet ellipse portion R 5 is formed so as to extend continuously with a curved surface of the top portion of the moving blade. The elliptical portion mentioned above is formed over the entire circumference of the base portion of the moving blade 1, and the base portion thus has a form that is capable of reducing thermal stress which is caused by high-temperature combustion gas.

Here, it should be mentioned that thermal stress of an especially large magnitude occurs between the base portion and the platform 2. The reason for this can be explained by the fact that since the moving blade 1 has a smaller heat capacity than the platform 2, the temperature of the moving blade 1 increases at a higher rate and within a shorter time period than that of the platform 2 upon start of the gas turbine. On the other hand, the temperature of the moving blade 1 falls at a higher rate and within a shorter time than that of the platform 2, whereby a large temperature difference occurs between the moving blade 1 and the platform 2. This in turn generates thermal stress. Consequently, the base portion is shaped in the form of a curved surface conforming to the fillet ellipse R to thereby reduce the thermal stress.

Recently, however, there is an increasing tendency to use a high temperature combustion gas to enhance the operating efficiency of the gas turbine. As a result, it becomes impossible to sufficiently suppress the thermal stress with only the base portion structure shaped in the form of the above mentioned fillet ellipse portion R, and cracks develop more frequently in the base portion where large thermal stress is induced. Under these circumstances, there is a demand for a structure of the blade base portion that is capable of reducing the thermal stress more effectively.

OBJECT OF THE INVENTION

In light of the state of the art described above, it is an object of the present invention to provide a cooled moving blade for a gas turbine which has a blade shape capable of reducing thermal stress more effectively than a conventional moving blade by adopting a partially improved shape of the fillet ellipse portion R which is formed between a base portion of the moving blade and a platform.

SUMMARY OF THE INVENTION

To achieve the object mentioned above, the present invention proposes the following means.

(1) A cooled moving blade for a gas turbine according to the present invention is mounted on a platform disposed circumferentially around a rotor and has an internal cooling air passage, wherein the cooled moving blade for the gas turbine has a blade profile which is constituted by a blade surface with an elliptical profile formed around a base portion of the moving blade which is in contact with the platform, a rectilinear blade surface portion formed in continuation with the elliptical blade surface over a predetermined length, and a curvilinear shaped blade surface extending continuously from the rectilinear blade surface portion to an end of the blade with a predetermined curvature.

The peripheral surface of the base portion of the moving blade which is in contact with the platform is formed as a curved surface conforming to an elliptic curve and the blade surface having a rectilinear surface portion is formed so as to extend continuously from the curved surface. Thus, the blade surface which is shaped in the form of a curved surface in the conventional moving blade is replaced by the rectilinear surface portion. In other words, the arcuate profile portion protruding convexly inward in a conventional moving blade is shaped in the rectilinear form. Consequently, the cross section of the blade is correspondingly enlarged outward with the cross-sectional area of the blade having the rectilinear surface portion being increased when compared with that of the conventional blade. As a result, the blade according to the present invention has a greater heat capacity than that of the conventional type blade, whereby temperature difference relative to the platform decreases in proportion to the increase of the heat capacity of the blade. Thus, the thermal stress due to the temperature difference between the blade and the platform is decreased when compared with the conventional blade. Moreover, since the cross-sectional area of the blade increases, the thermal stress decreases and it is possible to reduce the frequency at which cracks occur. Additionally, the length of the rectilinear surface portion should preferably be selected so as to cover a hub portion where thermal stress tends to be large, thereby ensuring a more advantageous effect.

(2) In the cooled moving blade for the gas turbine according to the present invention, cooling air holes communicated with the cooling air passage of the moving blade are additionally formed inside the platform. More specifically, the cooling air holes should preferably be formed at both sides of the platform so as to extend from a leading edge side of the moving blade to a trailing edge side thereof, while being communicated with the cooling air passage on the leading edge side of the moving blade.

A portion of the cooling air flowing through the cooling air passage formed inside the moving blade is introduced into the cooling air holes formed in the platform, and the cooling air is discharged into a combustion gas passage from an end portion of the platform after cooling the platform. Thus, in addition to the effect provided by the inventive structure (1) described above, the cooling effect is increased because the platform is also cooled, whereby cracks can be prevented from developing.

(3) Additionally, in the cooled moving blade for the gas turbine according to the present invention, the blade surface of the moving blade and the surface of the platform are coated with a heat-resisting material.

By coating the surface of the moving blade and that of the platform with a heat-resisting material, e.g., ceramics and the like, the moving blade and the platform can be protected against the effect of the heat of the high-temperature combustion gas. Thus, the thermal stress due to the heat of the high-temperature combustion gas can be reduced, whereby the effects provided by the inventive structures (1) and (2) mentioned above can be further enhanced.

DETAILED DESCRIPTION OF THE PREFERRED EMBODIMENTS

Figure 1:
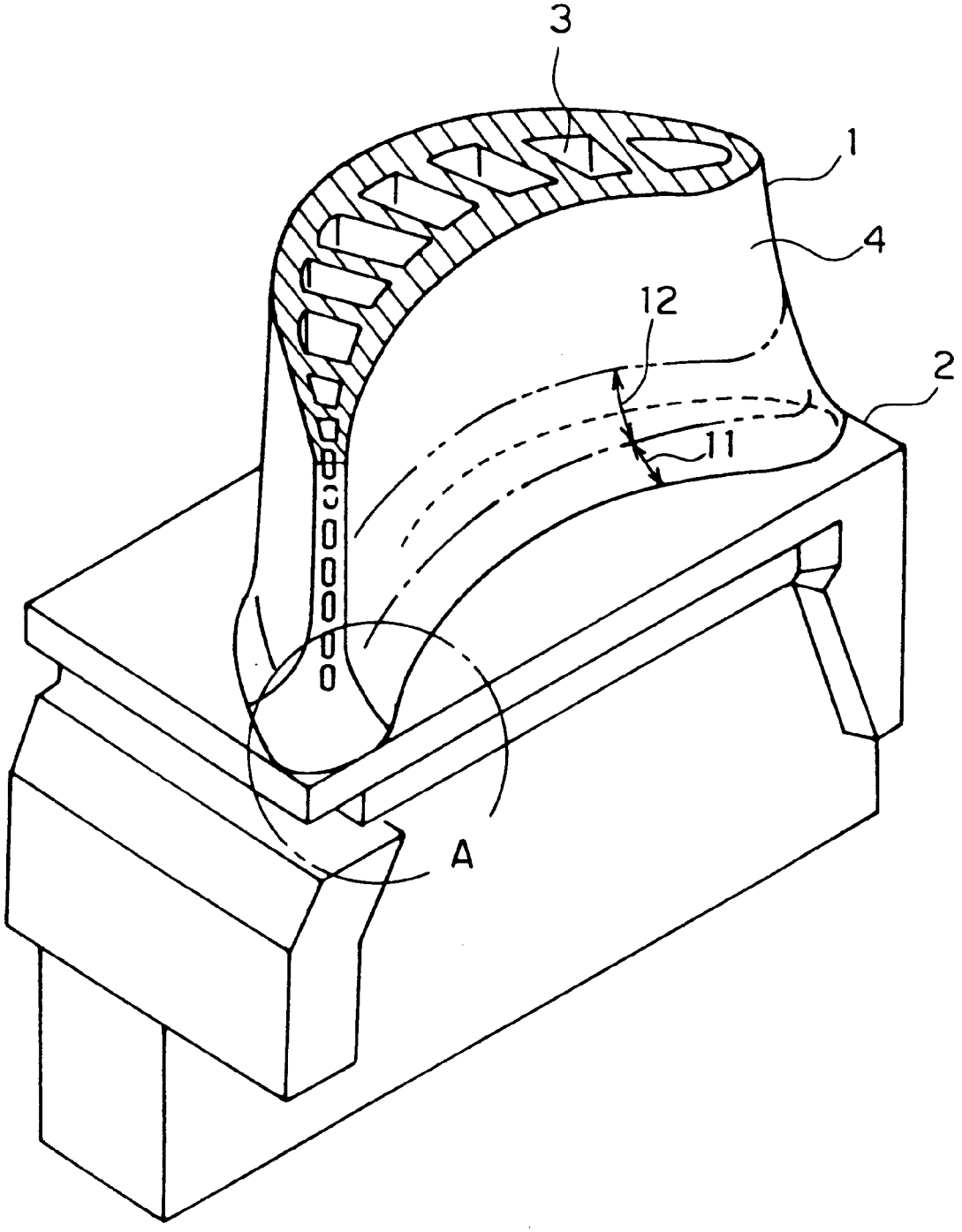
FIG. 1 is a perspective view showing a cooled moving blade for a gas turbine according to a first exemplary embodiment of the present invention.

The present invention will be described in detail in conjunction with what are presently considered preferred or typical embodiments thereof with reference to the appended drawings.

In the following description, like reference numerals designate like or corresponding parts throughout the drawings. Also in the following description, it is to be understood that terms such as "right", "left", "top", "bottom" and the like are words of convenience and are not to be construed as limiting terms.

Embodiment 1

Figure 2:
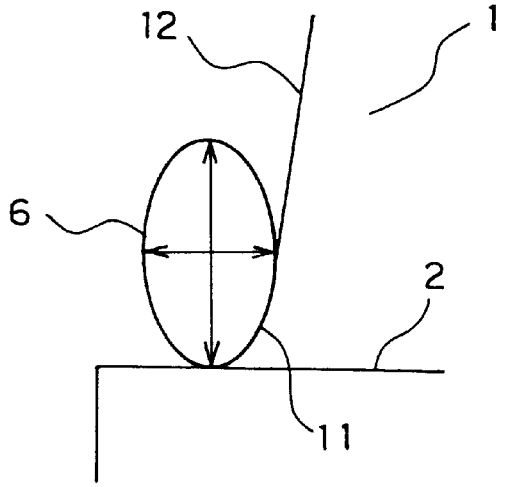
FIG. 2 is a schematic diagram showing details of a portion A shown in FIG. 1 in detail to illustrate a profile of a base portion of the blade.

FIG. 1 is a perspective view showing a cooled moving blade for a gas turbine according to a first exemplary embodiment of the present invention, and FIG. 2 is a diagram showing a portion A shown in FIG. 1 in detail to illustrate a profile of a base portion of the blade.

Referring to FIG. 1, a moving blade 1 is mounted on a platform 2 which is disposed around a rotor (not shown), wherein a cooling air passage 3 is formed inside the moving blade 1 between a leading edge thereof and a trailing edge in a serpentine pattern that sequentially extends upward and downward in a repetitious and continuous manner. Reference numeral 4 denotes a curved surface constituting a portion of the blade surface of the moving blade 1. The blade surface and the platform 2 are coated with a heat-resisting material such as ceramics and the like through a TBC (Thermal Barrier Coating) process. Further, reference numeral 11 designates an elliptically curved surface of the base portion of the blade, and numeral 12 designates a rectilinear surface portion of the blade.

FIG. 2 shows a profile of the blade base portion. Referring to the figure, a region of the blade base portion which lies adjacent to the platform 2 in contact therewith is imparted with the elliptically curved surface 11 conforming to an ellipse 6, and a rectilinear surface portion 12 is formed so as to continually extend from the elliptically curved surface 11. In the conventional moving blade, the portion corresponding to the rectilinear surface portion 12 in the moving blade according to the present invention is curvilinear. Further, it should be noted that the rectilinear surface portion 12 is provided in a hub region of the base portion in which the thermal stress of large magnitude tends to be induced.

Figure 3:
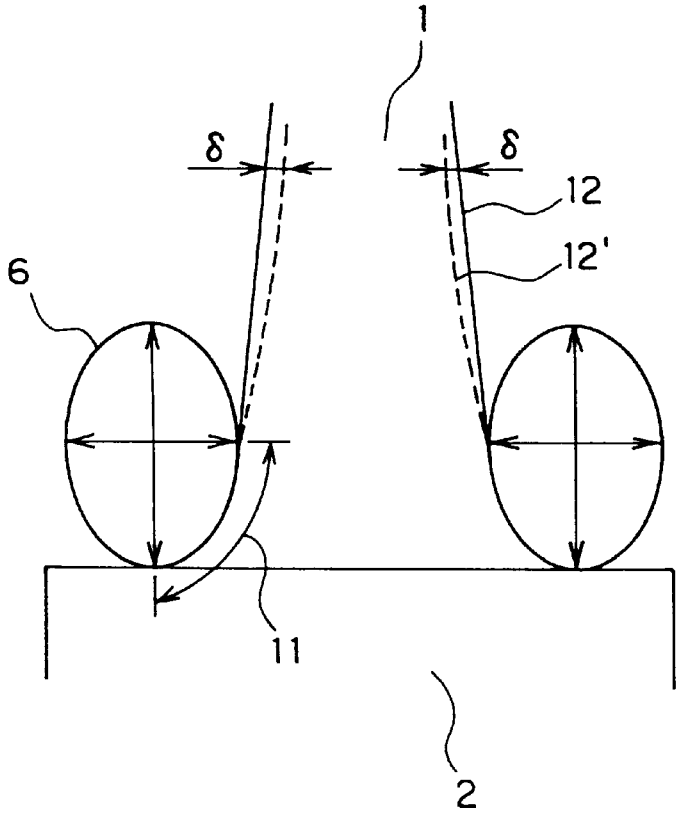
FIG. 3 is a view showing a profile of a cooled moving blade for a gas turbine according to the first exemplary embodiment of the present invention.

FIG. 3 shows a profile of the base portion of the cooled blade according to the first exemplary embodiment of the present invention. As can be seen in the figure, the base portion where the moving blade 1 is fixedly secured to the platform 2 is formed with elliptically curved surfaces 11, wherein the hub portions extending upward in continuation with the curved surface portions are formed as the rectilinear surface portions 12, respectively. Consequently, compared to the blade surface 12' of the conventional moving blade as indicated by dotted lines, a dimensional difference $\delta$ occurs in the blade thickness. By forming the moving blade in the profile provided with the rectilinear surface portions 12 as in the instant exemplary embodiment, the cross sectional area of the blade increases in proportion to the dimension $\delta$, which correspondingly contributes to increasing the heat capacity of the moving blade 1. Thus, compared with the conventional moving blade, the temperature difference occurring between the moving blade 1 and the platform 2 becomes smaller corresponding to the decreased difference in the heat capacity between the moving blade 1 and the platform 2. Moreover, compared with the conventional moving blade, heat and stress can be suppressed more effectively owing to the increased cross sectional area of the moving blade.

Embodiment 2

Figure 4:
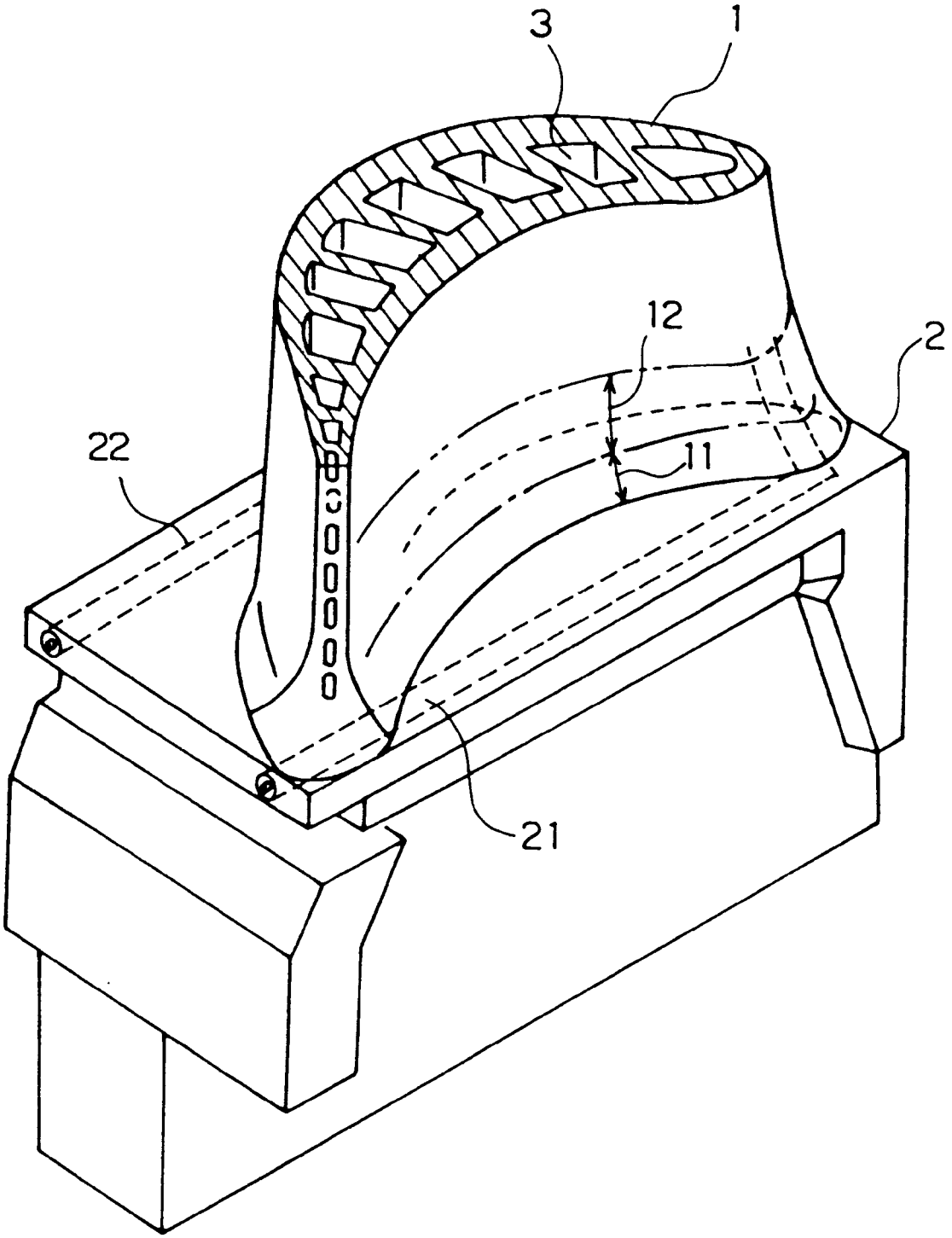
FIG. 4 is a perspective view showing a cooled moving blade for a gas turbine according to a second exemplary embodiment of the present invention.
Figure 5:
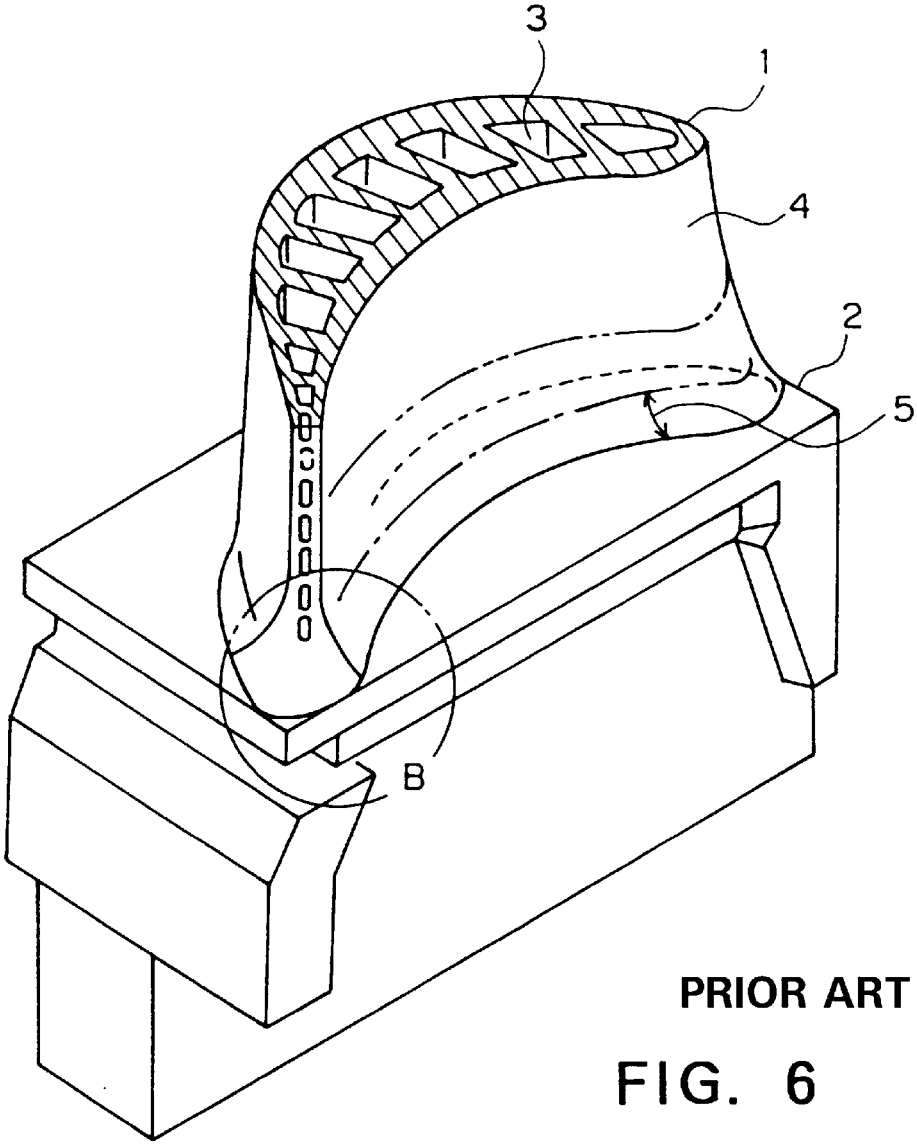
FIG. 5 PRIOR ART
FIG. 5 is a perspective view showing a conventional cooled moving blade for a gas turbine.
Figure 6:
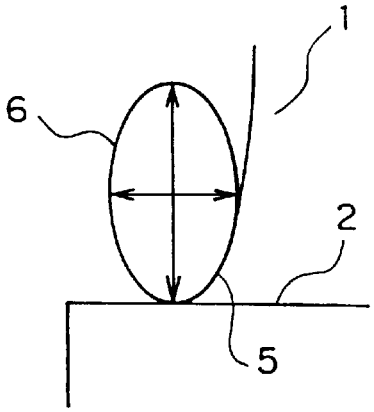
PRIOR ART FIG. 6
FIG. 6 is a schematic diagram showing a portion B shown in FIG. 5 in detail to illustrate a profile of a base portion of the blade.

FIG. 4 is a perspective view showing a cooled moving blade for a gas turbine according to a second exemplary embodiment of the present invention. Referring to the figure, the cooled moving blade for the gas turbine according to the instant exemplary embodiment differs from that of the first exemplary embodiment in that cooling air holes 21 and 22 communicated with the cooling air passage 3 at the leading edge portion of the moving blade 1 are formed in the platform 2 at both sides of the blade, respectively. Except for this structure difference, the structure of the cooled moving blade according to the second exemplary embodiment is essentially the same as that of the first exemplary embodiment. The cooling air holes 21 and 22 extract portions of the cooling air from the cooling air passage 3 to thereby flow this cooling air through interior lateral portions of the platform 2, and then discharge the cooling air from the blade trailing edge, whereby the platform 2 is cooled. Owing to the above arrangement for cooling the platform 2,the effect of the heat of the high-temperature gas can be suppressed, and the thermal stress can be further reduced in combination with the effect provided by the rectilinear surface portions 12 formed in the hub portion of the moving blade 1. Hence, cracks are prevented from developing.

As can be seen from the foregoing description, according to the teachings of the present invention incarnated in the first and second exemplary embodiments, since the rectilinear surface portions 12 are provided at the hub portion of the moving blade 1 and/or the cooling air holes 21 and 22 are provided in juxtaposition in the platform 2 of the moving blade 1 shaped as mentioned above, the thermal stress occurring at the blade base portion due to the high-temperature gas is decreased, whereby the generation of cracks is prevented. Moreover, since the rectilinear surface portions are provided in the hub portion of the moving blade, the cooling air holes 21 and 22 are provided in the platform 2 and the thermal barrier coating is applied, the blade base portion can be sufficiently protected against the effect of the heat of the high-temperature combustion gas, whereby the thermal stress can be further lowered.

In the foregoing, the embodiments of the present invention which are considered preferable at present and other alternative embodiments have been described in detail by reference with the drawings. It should, however, be noted that the present invention is never restricted to these embodiments but other various applications and modifications of the cooled moving blade for the gas turbine can be easily conceived and realized by those skilled in the art without departing from the spirit and scope of the present invention.

What is claimed is:

1. A cooled moving blade for a gas turbine mounted on a platform disposed circumferentially around a rotor and having an internal cooling air passage, wherein said cooled moving blade for a gas turbine has a blade profile constituted by a blade surface with an elliptical profile formed around a base portion of said moving blade in contact with said platform;

a rectilinear blade surface portion formed in continuation with said elliptical blade surface over a predetermined length; and a curvilinear shaped blade surface extending continuously from said rectilinear blade surface portion to an end of said blade with a predetermined curvature.

2. A cooled moving blade for a gas turbine as set forth in claim 1, wherein cooling air holes communicating with said cooling air passage of said moving blade, are formed inside of said platform.

3. A cooled moving blade for a gas turbine as set forth in claim 2, wherein said cooling air holes are formed at both sides of said platform so as to extend from a leading edge side of said moving blade to a trailing edge side thereof, and wherein said cooling air holes are communication with said cooling air passage on said leading edge side of said moving blade.

4. A cooled moving blade for a gas turbine as set forth in claim 1, wherein said blade surface of said moving blade and surface of said platform are coated with a heat-resisting material.

5. A cooled moving blade for a gas turbine as set forth in claim 1, wherein said rectilinear blade surface is disposed between said elliptical profile and said curvilinear shaped blade surface.

6. A cooled moving blade for a gas turbine as set forth in claim 2, wherein at least one of said cooling air holes includes an inlet opening and an outlet opening, said inlet opening being disposed adjacent to said cooling air passage so as to extract a portion of cooling air from the cooling air passage.

* * * * *